US005301467A

United States Patent [19]

Schmidt et al.

[11] Patent Number: 5,301,467

[45] Date of Patent: Apr. 12, 1994

[54] LOCKING SLIDE BLOCK

[75] Inventors: Melvin J. Schmidt, Lakeland, Minn.; Gary J. Marshik, Canton, S. Dak.

[73] Assignee: Andersen Corporation, Bayport, Minn.

[21] Appl. No.: 116,039

[22] Filed: Sep. 2, 1993

Related U.S. Application Data

[63] Continuation-in-part of Ser. No. 903,368, Jun. 24, 1992, Pat. No. 5,243,783.

[51] Int. Cl.[5] ..... E05D 15/22

[52] U.S. Cl. ..... 49/181; 49/176

[58] Field of Search ..... 49/161, 176, 177, 181, 49/380, 453, 454, 455; 16/197

[56] References Cited

U.S. PATENT DOCUMENTS

| | | | |
|---|---|---|---|
| 2,720,682 | 10/1955 | Perry | 20/12 |
| 2,731,287 | 1/1956 | Haynes | 292/76 |
| 2,883,226 | 4/1959 | Haynes | 292/76 |
| 3,044,062 | 9/1962 | Peters et al. | 20/42 |
| 3,195,174 | 7/1965 | Nobes | 16/202 |
| 3,377,747 | 4/1968 | Donkin | 49/414 |
| 3,399,490 | 9/1968 | Hettinger | 49/414 |
| 3,434,236 | 3/1969 | Weidner et al. | 49/176 |
| 3,524,282 | 8/1970 | Kraft et al. | 49/181 |
| 3,676,956 | 7/1972 | Taylor et al. | 49/446 |
| 3,789,549 | 2/1974 | Yip | 49/181 |
| 3,797,168 | 3/1975 | Trout | 49/181 |
| 3,842,540 | 10/1974 | Anderson | 49/181 |
| 3,844,066 | 10/1974 | Nobes | 49/182 |
| 4,068,406 | 1/1978 | Wood | 49/181 |
| 4,079,549 | 3/1978 | Wood | 49/181 |
| 4,115,973 | 9/1978 | Anderson | 52/773 |
| 4,137,671 | 2/1979 | Miller | 49/417 |
| 4,226,050 | 10/1980 | Kessler | 49/181 |
| 4,363,190 | 12/1982 | Anderson | 49/181 |
| 4,364,199 | 12/1982 | Johnson et al. | 49/181 |
| 4,452,012 | 6/1984 | Deal | 49/181 |
| 4,590,708 | 5/1986 | Campodonico | 49/181 |
| 4,610,108 | 9/1986 | Marshik | 49/181 |
| 4,683,676 | 8/1987 | Sterner | 49/181 |
| 4,718,194 | 1/1988 | Fitzgibbon et al. | 49/181 |
| 4,799,333 | 1/1989 | Westfall et al. | 49/446 |
| 4,813,180 | 3/1989 | Scalzi | 49/181 X |
| 4,922,657 | 5/1990 | Foss | 49/181 |
| 4,941,285 | 7/1990 | Westfall | 49/176 |
| 4,958,462 | 9/1990 | Cross | 49/181 |
| 5,077,939 | 1/1992 | Erickson | 49/380 |
| 5,243,783 | 9/1993 | Schmidt et al. | 49/181 |

FOREIGN PATENT DOCUMENTS 2121099 12/1983 United Kingdom .

*Primary Examiner*—Peter M. Cuomo
*Assistant Examiner*—Jerry Redman
*Attorney, Agent, or Firm*—Merchant, Gould, Smith, Edell, Welter & Schmidt

[57] ABSTRACT

The present invention is directed to a locking slide block slidably and pivotably mounting a window sash to a side member of a window frame having a vertical jamb channel. The locking slide block has a housing with oppositely disposed sliding surfaces for guiding the housing in the jamb channel. Operably connected to the housing is a locking means for selectively engaging the jamb channel and locking the housing in a fixed position, and a cam for selectively operating the locking means. A sash pivot operatively connected to the cam is operably connectable to the sash. The housing also has a sash pivot retainer spring. A retaining means is utilized to protect a free second end of the retainer spring from bowing and deforming due to forces applied to the window sash in operation.

14 Claims, 4 Drawing Sheets

FIG. 1
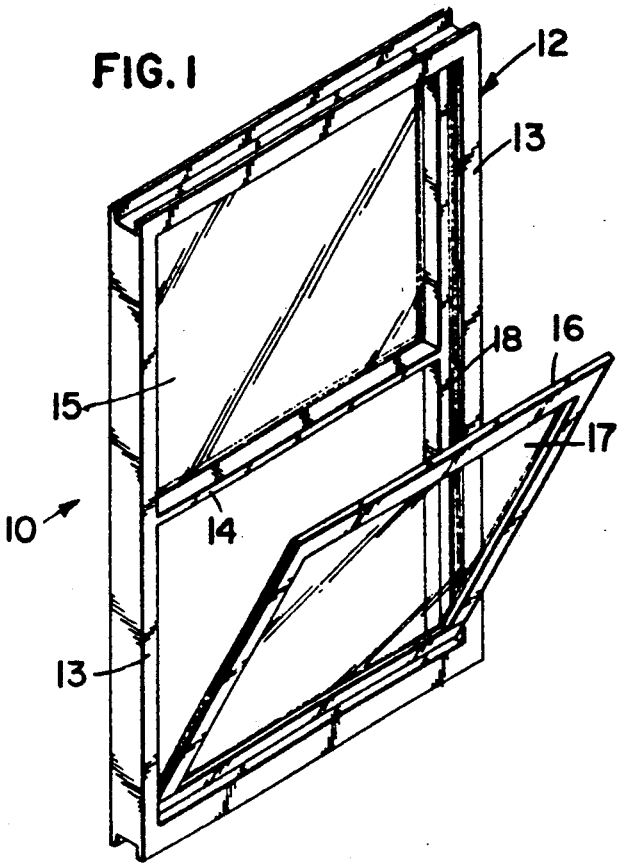
FIG. 3
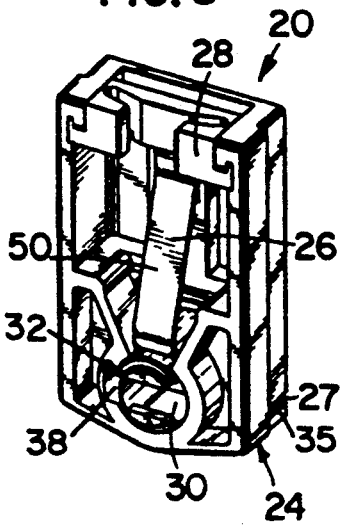
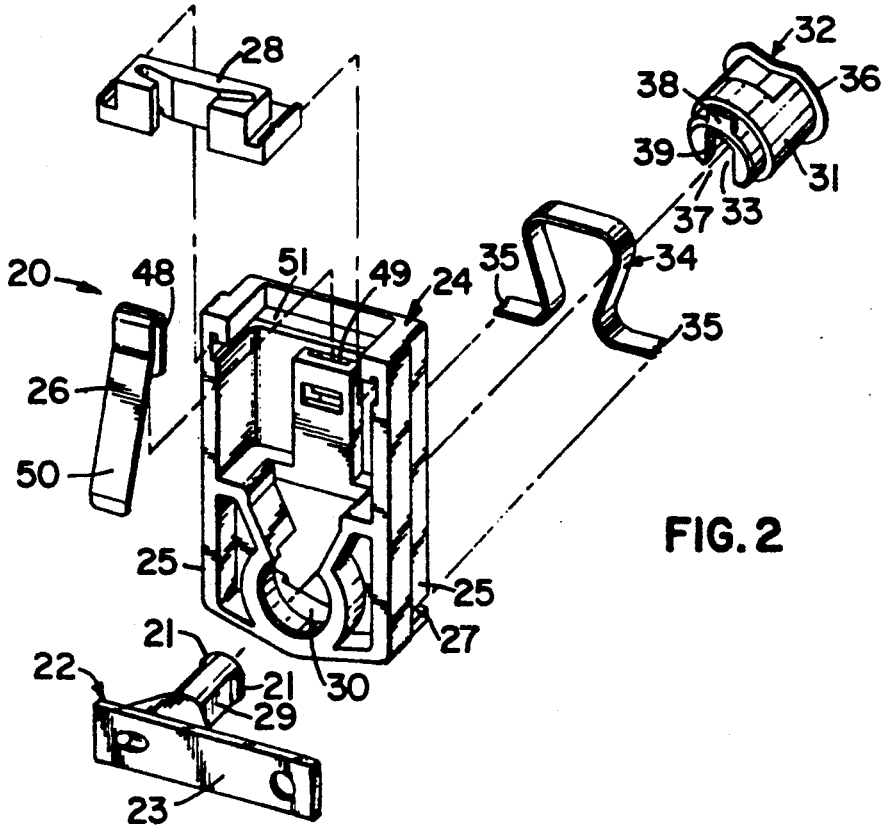
FIG. 2

LOCKING SLIDE BLOCK

This application is a continuation-in-part of U.S. Ser. No. 07/903,368 filed on Jun. 24, 1992 by Melvin J. Schmidt et al, now U.S. Pat. No. 5,243,783.

FIELD OF THE INVENTION

This invention generally relates to a locking slide block for double-hung tilt-out type windows.

BACKGROUND OF THE INVENTION

Double-hung, tilt-out type windows have become increasingly popular. Much of this popularity is due to the tilt-out feature which allows both inside and outside surfaces of the window to be cleaned from the inside.

Tilt-out windows have been equipped with locking slide blocks such as the one disclosed in U.S. Pat. No. 4,610,108 to Marshik. Marshik discloses a double-hung window having a frame with a set of parallel jamb channels on opposite sides of the frame. Within each jamb channel is a slidably mounted locking block. A spring counter-balance mechanism is attached to a headplate on each block. A pivot extends from proximate the lower end of opposite sides of a sash into a locking cam housed within the block. The pivots allow the sash, which holds a window pane, to be rotated or tilted toward the inside. As the pivots rotate, the cam forces serrated ends of a spring into opposite sides of the jamb channel to prevent the counter-balance spring from pulling up the blocks and sash while cleaning.

U.S. Pat. No. 4,813,180 to Scalzi discloses another locking sliding block for double-hung windows. Like the '108 patent, a locking block is slidably mounted within jamb channels and a pivot extends from opposite sides of the sash into a pivot button or cam in each locking block. Unlike the '108 patent, however, the pivot has a slot which engages a retaining ridge in the pivot button. This is intended to prevent dislocation of the pivots during transport and installation of the window due to deflection or bowing of the frame away from the sash. The locking block disclosed by Scalzi, although allowing the sash to pivot inside for easy cleaning of the window pane, does not allow the window to be conveniently removed from the inside.

SUMMARY OF THE INVENTION

The invention addresses many of the problems associated with the prior art in providing a locking slide block which enables the sash of a double-hung, tilt-out type window to be tilted to the inside to facilitate the cleaning, insertion and removal of the window sash and panes from a window frame. A sash pivot retaining spring configuration is utilized thereon to provide reliable, simple and relatively effortless operation of a locking slide block during shipping and installation, as well as in normal use.

In accordance with the invention, a locking slide block is provided for slidably and pivotably mounting a window sash to a side member of a window frame having a vertical jamb channel with oppositely disposed sides. The block has a housing with oppositely disposed sliding surfaces for guiding the housing in the jamb channel. Within the block is a locking means for selectively engaging the oppositely disposed sides of the jamb channel to lock the block in a fixed position relative to the jamb channel. A cam is disposed within the housing. The cam has at least one camming surface which selectively operates the locking means. The cam also has a sash pivot opening with an open top slot, for attaching a sash pivot thereto. Sash pivots are operatively connectable to each lower opposite side of a sash, for operatively connecting the sash to the cam.

The locking slide block also has a sash pivot retainer spring having a first end operatively connected to the housing and a second end proximate the cam. The second end has a first position for allowing the sash pivot to be inserted or removed from the sash pivot opening through the open top slot. The second end also has a second position for preventing removal of the sash pivot through the open top slot. The second end is normally biased to the second position, and may be depressed to the first position.

The locking slide block also preferably includes a second end retaining means. The second end retaining means is operatively connected to the housing, and it operates to restrict movement of the second end of the retainer spring past the second position in a direction opposite that of the first position. This protects the second end from deforming due to forces applied to the window sash in operation, and thus increases the overall reliability of the slide block.

In a preferred embodiment, the second end retaining means utilizes at least one spring retaining flange which extends across a portion of a spring receiving recess to cooperatively about the second end of the spring in its second position. Further, cooperative flanges may also be utilized on the retainer spring to facilitate this abutting relationship between the spring and the spring retaining flange.

These and other advantages and features, which characterize the invention, are pointed out with particularity in the claims annexed hereto and forming a part hereof. However, for a better understanding of the invention, its advantages and objectives attained by its use, reference should be made t drawing which forms a further part hereof and to the accompanying descriptive matter, in which there is described a preferred embodiment of the invention.

BRIEF DESCRIPTION OF THE DRAWINGS

FIG. 1 shows a double-hung window with a partially tilted sash.

FIG. 2 shows an exploded perspective view of a locking slide block with sash pivot consistent with the invention, for use in the double-hung window in FIG. 1.

FIG. 3 shows an assembled locking slide block without sash pivot with the invention.

DETAILED DESCRIPTION OF THE PREFERRED EMBODIMENT

Figure 5:
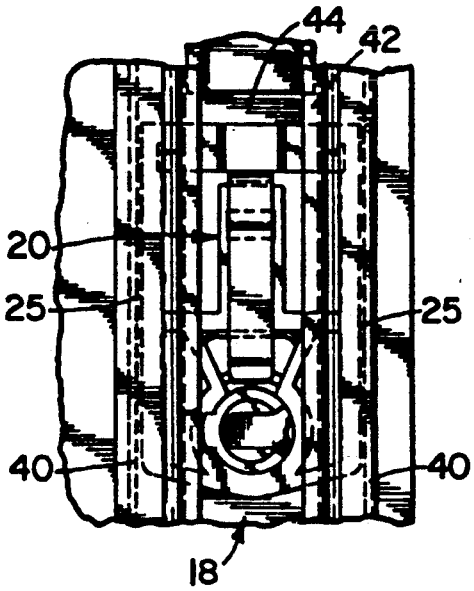
FIG. 5 shows a locking slide block in an unlocked position a jamb channel.

Referring now to the drawing, wherein like referenced numerals designate identical or corresponding parts throughout the several views, FIG. 1 shows a double-hung tilt-out window 10. The window 10 has a frame 12 and an upper sash 14 and a lower sash 16 supporting window panes 15 and 17, respectively. The frame 12 also has four jamb channels 18, one of which is shown in FIG. 1, on a side member 13 of frame 12. One jamb channel is proximate opposite sides of the upper sash 14, and one is proximate opposite sides of lower sash 16. As shown in FIG. 1, the lower sash 16 is partially tilted so that both sides of the window pane 17 within the lower sash 16 are accessible for cleaning from the same side of window 10.

FIG. 2 shows an exploded view of a locking slide block, generally referred to as 20, and sash pivot 22 of the present invention. One locking slide block 20 is slidably mounted within each jamb channel 18. Fastened to lower opposite sides of each sash 14 and 16 is one sash pivot 22. These sash pivots 22 are supported for rotation by the locking slide blocks 20. Each sash is tiltable about a longitudinal axis through pivots 22 disposed on opposite sides of sashes 14 and 16.

As shown in FIG. 2, locking slide block 20 has a housing 24, preferably of rigid plastic. This housing 24 has sliding surfaces 25 with slots 27. The housing 24 has an aperture 49 and a plate groove 51 for attaching a sash pivot retainer spring 26 and a metal plate 28, respectively. A counter-balance spring (not shown) is attached to metal plate 28. The housing 24 has a circular channel 30, which extends into housing 24 generally parallel to sliding surfaces 25, for receiving a locking cam 32 having camming surfaces 31. Housing 24 also has a box-like area for receiving locking spring 34 which has serrated end portions 35. Locking cam 32 has a head 35 which, as known to those skilled in the art, retains spring 34 in the box-like area of housing 24.

Sash pivot retainer spring 26, as shown in FIG. 2, has a hooked first end 48 which is received by aperture 49 to operably connect retainer spring 26 to housing 24. Retainer spring 26 also has a free end 50. Retainer spring 26 is preferably constructed of spring steel.

Locking cam 32, as shown in FIG. 2, has a sash pivot opening 33 with an open top slot 37. Located proximate a front side of locking cam 32, on opposite sides of sash pivot opening 33 are inwardly disposed cam flanges 39.

FIG. 3 shows a perspective view of the assembled locking slide block 20 without sash pivot 22. Retainer spring 26 and plate 28 are shown installed within housing 24. Free end 50 of spring 26 is in a normal position proximate the front side of locking cam 32. Locking cam 32 is shown inserted within circular channel 30, and is retained within block 20 by a tab 38. FIG. 3 also shows one serrated end portion 35 of spring 34 retracted within slot 27 in sliding surface 25.

Figure 4:
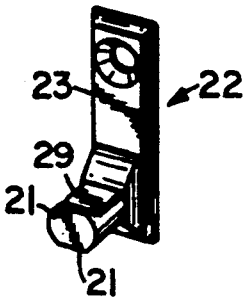
FIG. 4 shows a perspective view of the sash pivot.

FIG. 4 is a front view of sash pivot 22 having oppositely disposed flanges 21 at one end of an elongated portion 29, and a back 23. Sash pivots 22 are fastened to the lower opposite sides of sashes 14 and 16 so that the lengthwise axis of back 23 is parallel to the lengthwise axis of the sash side.

FIG. 5 shows locking slide block 20 inserted in jamb channel 18 having sides 40. Sliding surfaces 25 of sliding locking block 20 are proximate side 40 of jamb channel 18. Locking slide block 20 is held within jamb channel 18 by a flexible raised jamb channel face 42 having opening 44.

Figure 6:
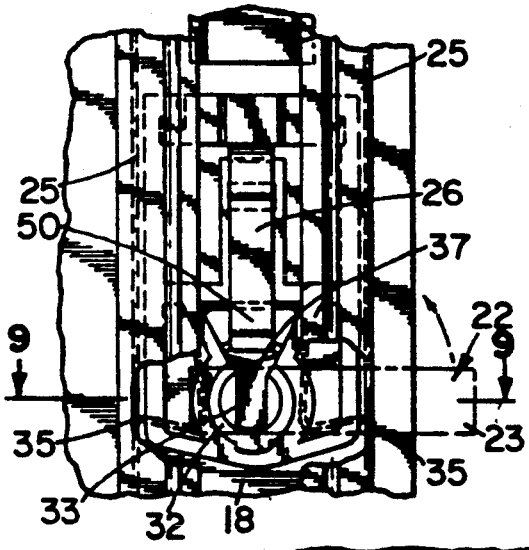
FIG. 6 shows a locking slide block in a locked position a jamb channel.

As shown in FIG. 6, the serrated portions of spring 34 are engaged with sliding surfaces 25 to prevent the counter-balance spring from pulling locking slide block 20 and sash 14 or 16 upward when sash 14 or 16, respectively, is tilted. When sash 14 or 16 and, thus back 23, is rotated from vertical, locking cam 32 rotates so that camming surfaces 31 force serrated end portions 35 of spring 34 out slots 27. In FIG. 6, back 23 is tilted to a horizontal position at approximately 90° to jamb channel 18. This position also corresponds to sash 14 or 16 tilted at 90° to jamb channel 18.

Also shown in FIG. 6, sash pivot 22 is operably connected to locking cam 32 by rotating cam 32 (by a tool not shown) so that open top slot 37 opens upward beneath retainer spring 26. Sash pivot 22 is inserted into sash pivot opening 33 by depressing the free end 50 of retainer spring 26 inwardly away from the front side of locking cam 32 to a first depressed position. After sash pivot 22 is inserted in sash pivot opening 33, the free end of retainer spring 26 moves back to a normal, second position over opening 33. Once retainer spring 26 moves back over opening 33, sash pivot 22 cannot slip out of opening 33. Without retainer spring 26, sash pivot 22 might slip out of opening 33 when sash 14 or 16 is tilted.

Figure 9:
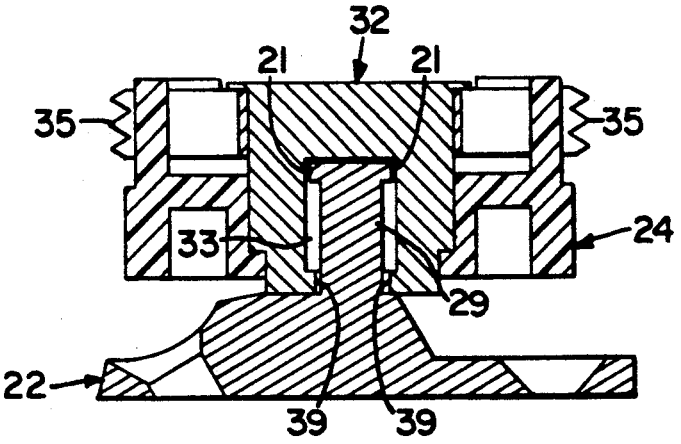
FIG. 9 shows a cross-section of the locking slide block shown in FIG. 6.

As best shown in FIG. 9, a cross-sectional view of cam 32 and sash pivot 22 taken from FIG. 6, when sash pivot 22 is inserted into sash pivot opening 33, the elongated portion 29 extends into the opening beyond cam flanges 39. Flanges 21 of sash pivot 22 are disposed widely enough that when sash pivot 22 is inserted in this manner, flanges 21 engage with cam flanges 39 so that sash pivot 22 cannot be pulled out of the pivot opening in a direction proximately parallel to a longitudinal axis of the elongated portion 29. This feature is particularly important during transport and installation of window 10. During transport and installation, side members 13 of frame 12 may bow outwardly away from sashes 14 and/or 16 so that without the engagement of flanges 21 with cam flanges 39, elongated portion 29 of sash pivot 22 could be pulled out of sash pivot opening 33.

Figure 7:
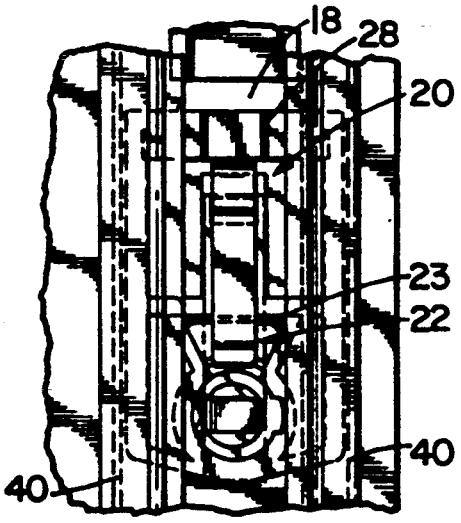
FIG. 7 shows a mirror image of the locking slide block of FIG. 5.

FIG. 7 shows back 23 of sash pivot 22 oriented vertically. This position of back 23 corresponds to the closed or vertical position of sash 14 or 16. Serrated end portions 35 of spring 34 are not engaged with sides 40 of jamb channel 18. Locking slide block 20 and sash 14 or 16 is thus free to slide vertically within jamb channel 18. The counter-balance spring (not shown) attached to plate 28 assists in sliding locking slide blocks 20 and sashes 14 or 16 upward in jamb channels 18.

Figure 8:
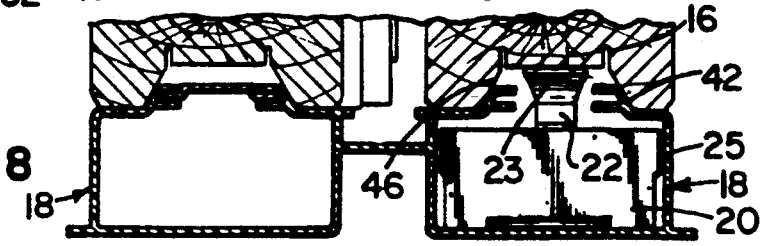
FIG. 8 shows parallel jamb channels, one with a counter-balance spring cover and the other having a locking slide block with sash pivot.

FIG. 8 shows a cross-sectional view of parallel jamb channels 18. In one of the jamb channels 18 is shown locking slide block 20 without serrated end portions 35 of spring 34 extending beyond sides 25 of locking slide block 20. As previously shown in FIG. 7, back 23 of sash pivot 22 is positioned vertically. Flexible jamb channel face 42 is engaged with a sash groove 46 to retain sash 16 vertically within frame 12 (not shown).

Figure 10:
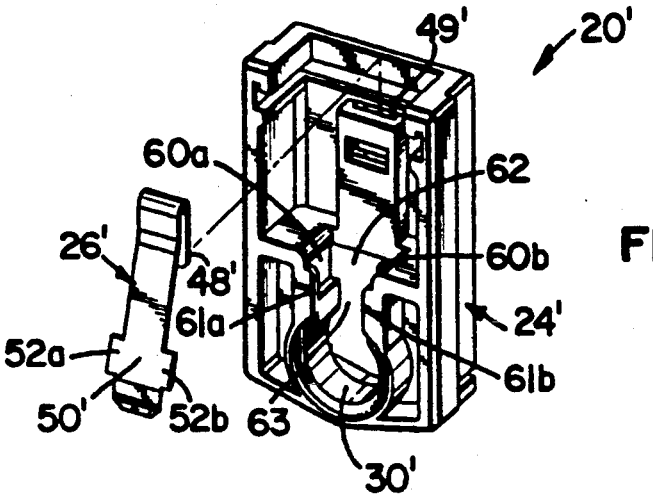
FIG. 10 shows an exploded perspective view of an alternative housing and retaining spring consistent with the invention.
Figure 11:
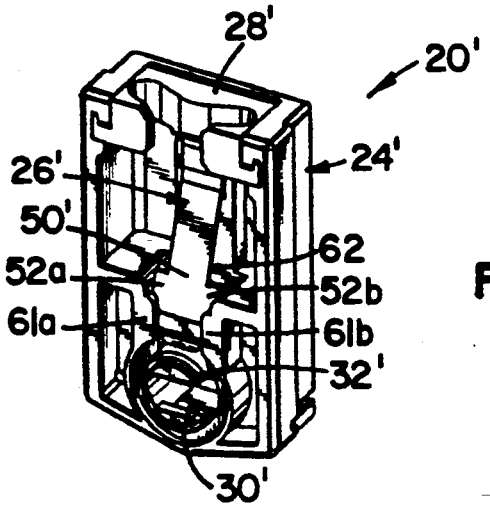
FIG. 11 shows a perspective view of an assembled locking slide block without sash pivot, and with the housing and retaining spring of FIG. 10.

FIGS. 10 and 11 show an alternative embodiment of the locking slide block consistent with the invention. It has been discovered that in certain instances, forces applied to a sash may be applied by a sash pivot to the retainer spring in a locking slide block, causing the retainer spring to "buckle" and bow outward from the force. In certain circumstances, this may result in the sash pivot becoming partially dislodged from the sash pivot opening in the cam, thereby jamming the slide block and preventing the sash from moving up or down in the jamb channel.

For example, as best seen in FIG. 6, when sash 14 or 16 is tilted, open top slot 37 may be oriented upward and directly opposite retainer spring 26. An upward force on sash 14 or 16, for instance applied by gripping the sash on the sides near sash pivots 22, tends to urge elongated portion 29 of sash pivot 22 against the free end 50 of retainer spring 26. Since spring 26 extends generally away from housing 24 at the hooked first end 48, any force applied to free end 50 may induce this end to bow outward from housing 24. Given a sufficient force, free end 50 may buckle outward and allow sash pivot 22 to become partially dislodged from its operating position.

The alternative embodiment shown in FIGS. 10 and 11 includes a retaining means for protecting the free end of a retainer spring from the upward forces that could possibly cause failure of the locking slide block. As shown in FIG. 10, locking slide block 20' includes an alternative housing 24' and retainer spring 26'.

Housing 24' has a spring receiving recess 62 which extends into housing 24' for housing retainer spring 26' in operation. This recess 62 is integrally joined to the cam receiving channel 30' which, in operation, houses the locking cam. In order to protect retainer spring 26' from the above-described forces, a pair of spring retaining flanges 61*a* and 61*b* are provided which extend across a portion of recess 62. In the preferred embodiment, flanges 61*a* and 61*b* extend outward from walls 60*a* and 60*b* of recess 62. Other flange configurations may also be used in lieu of that shown for flanges 61*a* and 61*b*.

Sash pivot retainer spring 26' has a hooked first end 48' which is received by aperture 49' to operably connect retainer spring 26' to housing 24'. Further, retainer spring 26' includes a free end 50', which has a pair of oppositely disposed and outwardly projecting spring flanges 52*a* and 52*b*.

FIG. 11 shows an assembled locking slide block 20' without a sash pivot installed. Here, retainer spring 26' is installed, with metal plate 28' holding the spring in position. Free end 50' is housed within recess 62, proximate flanges 61*a* and 61*b*, and proximate cam 32'. In the configuration shown, when free end 50' is not depressed and in the normal position, spring flanges 52*a* and 52*b* cooperatively abut spring retaining flanges 61*a* and 61*b*. This cooperatively abutting relationship protects spring 26' when upward forces are applied to free end 50' by a sash pivot. Free end 50' is not capable of bowing outward in a direction opposite the normal direction in which free end 50' is depressed (such as when inserting or removing a sash pivot). Thus, the free end is substantially protected from deforming due to these forces.

Returning to FIG. 10, it may also be seen that it is preferable to leave sufficient space, i.e., a channel 63, in between flanges 61*a* and 61*b*. This enables a sash pivot to be inserted and removed from locking slide block 20' through channel 63.

One skilled in the art will appreciate that various modifications may be made without departing from the scope of the invention. For example, a number of different sizes and configurations of spring retaining flanges may be used to abut with free end 50' to protect it from bowing outward. In addition, other spring flanges could be incorporated into free end 50' to cooperatively abut with the flanges over recess 62. Further, spring flanges 52*a* and 52*b* could be eliminated altogether as long as flanges 61*a* and 61*b* extend a sufficient distance across recess 62 to abut with free end 50' during normal use. It is further not necessary that flanges 52*a* and 52*b* abut flanges 61*a* and 61*b* in normal operation, as the normal operating position of free end 50' may be disposed away from the plane of flanges 61*a* and 61*b* in its normal position.

Although characteristics and advantages, together with details of structure and function, have been described in reference to the preferred embodiments herein, it is understood that the disclosure is illustrative. To that degree, various changes made, especially in matters of shape, size and arrangement, to the full extent extended by the general meaning of the terms in which the appended claims are expressed, are within the principles of the present invention.

We claim:

1. A locking slide block for slidably and pivotably mounting a window sash to a side member of a window frame having a vertical jamb channel, the slide block comprising:

(a) a housing having oppositely disposed sliding surfaces for guiding the housing in a jamb channel;

(b) locking means for selectively engaging the jamb channel and locking the slide block in a fixed position relative to the jamb channel;

(c) a cam disposed in the housing, the cam having at least one camming surface arranged and configured to selectively operate the locking means, and wherein the cam includes a sash pivot opening having an open top slot;

(d) a sash pivot operatively connected to the cam in the sash pivot opening, and wherein the sash pivot is operatively connectable to a window sash;

(e) a sash pivot retainer spring, the retainer spring having a first end operatively connected to the housing and a second end proximate the cam, wherein the second end has a first position for allowing the sash pivot to be inserted or removed from the sash pivot opening through the open top slot and a second position for preventing removal of the sash pivot through the open top slot, the second end being normally biased to the second position and depressible to the first position; and (f) second end retaining means, operatively connected to the housing, for restricting movement of the second end past the second position in a direction opposite the first position; whereby the second end is protected from deforming due to forces applied to the window sash in operation.

2. The locking slide block of claim 1, wherein the retaining spring is disposed within a spring receiving recess extending into the housing, and wherein the second end retaining means comprises at least one spring retaining flange, extending across at least a portion of the spring receiving recess, and arranged and configured to cooperatively abut the second end of the retaining spring when the retaining spring is in the second position.

3. The locking slide block of claim 2, wherein the retainer spring comprises at least one spring flange, disposed on the second end, and arranged and configured to cooperatively abut with the at least one spring retaining flange when the second end is in the second position.

4. The locking slide block of claim 1, wherein the second end is disposed proximate the sash pivot opening, and wherein the second position at least partially covers the open top slot for preventing removal of the sash pivot through the open top slot.

5. The locking slide block of claim 1, wherein the locking means is a locking spring having oppositely disposed serrated end portions.

6. The locking slide block of claim 1, further comprising a plate for attaching a counterbalance spring.

7. The locking slide block of claim 1, wherein:

(a) the sash pivot has a longitudinal axis and two flanges, located at one end of an elongated portion of the sash pivot and oppositely and outwardly disposed from the longitudinal axis of the sash pivot; and (b) the open top slot is defined by a bottom, a first side and a second side, the first and second sides each having a cam flange, wherein the elongated portion of the sash pivot may be inserted into the open top slot such that the flanges of the sash pivot engage with the cam flanges to prevent the sash pivot from being pulled out of the sash pivot opening in a direction generally parallel to the longitudinal axis of the elongated portion of the pivot.

8. A locking slide block for slidably and pivotably mounting a window sash to a side member of a window frame having a vertical jamb channel, the slide block comprising:

(a) a housing having:

(i) oppositely disposed sliding surfaces for guiding the housing in a jamb channel;

(ii) a cam receiving channel extending into the housing generally parallel to the sliding surfaces;

(iii) a spring receiving recess extending into the housing and integrally joined to the cam receiving channel; and (iv) at least one spring retaining flange, extending across at least a portion of the receiving recess proximate the cam receiving channel;

(b) locking means for selectively engaging the jamb channel and locking the slide block in a fixed position relative to the jamb channel;

(c) a cam disposed in the cam receiving channel, the cam having at least one camming surface arranged and configured to selectively operate the locking means, and wherein the cam includes a sash pivot opening having an open top slot;

(d) a sash pivot operatively connected to the cam in the sash pivot opening, and wherein the sash pivot is operatively connectable to a window sash; and (e) a sash pivot retainer spring disposed in the spring receiving recess, the retainer spring having a first end operatively connected to the housing and a second end proximate the at least one spring retaining flange, wherein the second end has a first position for allowing the sash pivot to be inserted or removed from the sash pivot opening through the open top slot and a second position for preventing removal of the sash pivot through the open top slot, the second end being normally biased to the second position and depressible to the first position, and wherein the second end is arranged and configured such that the at least one spring retaining flange restricts movement of the second end past the second position in a direction opposite the first position; whereby the second end is protected from deforming due to forces applied to the window sash in operation.

9. The locking slide block of claim 8, wherein the retainer spring comprises at least one spring flange, disposed on the second end, and arranged and configured to cooperatively abut with the at least one spring retaining flange on the housing when the second end is in the second position.

10. The locking slide block of claim 8, wherein the housing comprises two oppositely disposed spring retaining flanges, each spring retaining flange extending across at least a portion of the receiving recess proximate the cam receiving channel, wherein the spring retaining flanges define a channel therebetween, the channel being sized such that the sash pivot is capable of passing through the channel when the sash pivot is being inserted or removed from the sash pivot opening through the open top slot.

11. The locking slide block of claim 8, wherein the second end is disposed proximate the sash pivot opening, and wherein the second position at least partially covers the open top slot for preventing removal of the sash pivot through the open top slot.

12. The locking slide block of claim 8, wherein the locking means is a locking spring having oppositely disposed serrated end portions.

13. The locking slide block of claim 8, further comprising a plate for attaching a counterbalance spring.

14. The locking slide block of claim 8, wherein:

(a) the sash pivot has a longitudinal axis and two flanges, located at one end of an elongated portion of the sash pivot and oppositely and outwardly disposed from the longitudinal axis of the sash pivot; and (b) the open top slot is defined by a bottom, a first side and a second side, the first and second sides each having a cam flange, wherein the elongated portion of the sash pivot may be inserted into the open top slot such that the flanges of the sash pivot engage with the cam flanges to prevent the sash pivot from being pulled out of the sash pivot opening in a direction generally parallel to the longitudinal axis of the elongated portion of the pivot.

* * * * *